US005802934A

United States Patent [19]

Harriot et al.

[11] Patent Number: 5,802,934

[45] Date of Patent: Sep. 8, 1998

[54] ANGULARLY ADJUSTABLE SOCKET WRENCH

[75] Inventors: Cameron Harriot, Huntington Beach; Marlene Faye Kaufman, Adelanto; Richard Lawrence Jetter, Los Angeles, all of Calif.

[73] Assignee: Northrop Grumman Corporation, Los Angeles, Calif.

[21] Appl. No.: 756,531

[22] Filed: Nov. 26, 1996

[51] Int. Cl.[6] ..... B25G 3/02; B25B 23/16

[52] U.S. Cl. ..... 81/177.85; 81/177.75; 81/124.2

[58] Field of Search ..... 81/177.85, 177.8, 81/177.7, 177.75, 124.2, 124.6; 403/73–74, 76, 78–79, 57–58

[56] References Cited

U.S. PATENT DOCUMENTS

| | | | |
|---|---|---|---|
| 798,325 | 8/1905 | Daddysman, Jr. . | |
| 827,250 | 7/1906 | Measer | 81/177.75 |
| 905,070 | 11/1908 | Heck | 81/177.85 X |
| 1,334,154 | 3/1920 | Harrison . | |
| 1,392,220 | 9/1921 | Quint . | |
| 1,578,114 | 3/1926 | Fegley | 81/177.85 X |
| 1,638,252 | 8/1927 | Fitzgerald, Jr. . | |
| 1,685,446 | 9/1928 | Benedict . | |
| 1,867,372 | 7/1932 | McGuckin | 81/124.2 |
| 1,982,008 | 11/1934 | Mandl et al. | 81/177.85 X |
| 2,503,364 | 4/1950 | Viets . | |
| 3,039,340 | 6/1962 | Livermont . | |
| 3,086,414 | 4/1963 | Nardi . | |
| 4,096,621 | 6/1978 | Berger et al. | 81/124.2 X |
| 4,108,027 | 8/1978 | Lenker | 81/177.75 X |
| 4,393,583 | 7/1983 | Zwald . | |
| 4,436,005 | 3/1984 | Hanson | 81/177.85 X |
| 4,508,005 | 4/1985 | Herman et al. | 81/177.85 |
| 4,749,251 | 6/1988 | Moulin | 81/124.2 X |
| 4,807,499 | 2/1989 | Martinez . | |
| 5,048,378 | 9/1991 | Nikolas . | |
| 5,257,556 | 11/1993 | Pineault | 81/124.2 |

FOREIGN PATENT DOCUMENTS

| | | | |
|---|---|---|---|
| 0308968 | 3/1989 | European Pat. Off. | 81/177.75 |
| 20101 | 9/1907 | United Kingdom | 81/177.75 |
| 179806 | 5/1922 | United Kingdom | 81/177.75 |

*Primary Examiner*—D. S. Meislin

*Attorney, Agent, or Firm*—Terry J. Anderson; Karl J. Hoch, Jr.

[57] ABSTRACT

A socket wrench includes a handle bearing shaft and a socket member. The shaft carries a handle at one end thereof and has an opposing terminal end that tapers in opposite directions and evinces a polygonal cross-section. This terminal end is retained within a first bore provided in one section of the socket member. The first bore is also polygonal in shape such that the shaft drivingly engages the socket member. The terminal end of the shaft is retained in the first bore through a slotted connection in order to permit relative angular movement between the shaft and the socket member while maintaining the positive drive connection therebetween. The socket member includes another section that defines an internal, polygon-shaped socket for receiving a nut or the head of a bolt to be manipulated through the use of the wrench. This socket opens into a second bore formed in the section of the socket member containing the first bore. This second bore is adapted to receive a portion of a swingbolt or the like upon tightening of the same with the socket wrench. An arcuate notch is also formed along an arcuate portion of the socket in order to aid in accessing and removing the socket member from a nut or bolt when an auxiliary connector or the like is obstructing the path of the socket wrench.

1 Claim, 2 Drawing Sheets

ANGULARLY ADJUSTABLE SOCKET WRENCH

BACKGROUND OF THE INVENTION

1. Field of the Invention

The present invention pertains to the art of tools and, more particularly, an angularly adjustable socket wrench.

2. Discussion of the Prior Art

A wide variety of socket wrenches exist in today's marketplace. Most often, these known socket wrenches are designed for particular applications, although these socket wrenches might actually be used in various fields. Unfortunately, particular situations arise which require the use of a socket wrench but wherein known socket wrenches fail to perform adequately.

For example, in the aerospace industry, it is common to utilize swingbolts to secure electronic line replaceable units, such as a commonly referred to "Black Box", within a rack provided on an airplane. In general, the line replaceable unit (LRU) is slid into a holding compartment formed in the rack and is held in a desired position by angularly adjusting and tightening of various swingbolts. Where hand tightening of such swingbolts is not feasible, the use of a wrench is required.

It has been found that tightening such swingbolts with known wrenches is time consuming and sometimes impossible due to accessibility constraints. For instance, due to space constrictions, fixed cross beams or stress members for the airplane are often located in front of the holding compartments and therefore interfere with direct, in-line access to the swingbolts. If wrenches are used which rub against the stress members, the stress members may become undesirably notched or the protective coatings thereon could become worn away thereby exposing the metal to potential corrosion problems. In addition, connectors from adjacent structure often project into the paths of the swingbolts and these connectors can obstruct the attachment or removal of a wrench from the swingbolts. Finally, the specific configuration of the swingbolts themselves can limit the use of any particular wrench therewith.

Therefore, there exists a need in the art for a socket wrench that can be used in certain environments where space and structural constraints prohibit or render difficult the use of conventionally known wrenches.

SUMMARY OF THE INVENTION

The invention overcomes the problems associated in this art by providing a versatile socket wrench that is specifically designed to be easily maneuvered about obstructing objects, which can be universally used in particular environments such as securing LRU's in airplanes and which represents a simple and cost efficient assembly.

The socket wrench of the invention includes a handle bearing shaft and a socket member that is interconnected to the shaft in a manner which permits relative angular movement between the shaft and the socket member. More specifically, the shaft carries a handle at one end thereof and has an opposing terminal end that evinces a polygonal cross-section. This terminal end is retained within a first bore provided in one section of the socket member. The first bore is also polygonal in shape such that the shaft drivingly engages the socket member. However, the terminal end of the shaft tapers in opposite directions and is retained in the first bore through a slotted connection in order to permit relative angular movement between the shaft and the socket member while maintaining the positive drive connection therebetween.

The socket member includes another section that defines an internal, polygon-shaped socket for receiving a nut or the head of a bolt to be manipulated through the use of the wrench. This socket opens into a second bore formed in the section of the socket member containing the first bore. This second bore is adapted to receive a portion of a swingbolt or the like upon tightening of the same with the socket wrench. An arcuate notch is also preferably formed along an arcuate portion of the socket in order to aid in accessing and removing the socket member from a nut or bolt when an auxiliary connector or the like is obstructing the path of the socket wrench.

With this construction, the socket wrench of the invention has a wide range of applications, yet will solve particular problems encountered in certain environments. In addition, the socket wrench is simple in construction thereby making the manufacture thereof easy and cost effective. Additional features and advantages of the socket wrench of the invention will become more readily apparent from the following detailed description of a preferred embodiment thereof when taken in conjunction with the following drawings wherein like reference numerals refer to corresponding parts in the several views.

DETAILED DESCRIPTION OF THE PREFERRED EMBODIMENT

Figure 1:
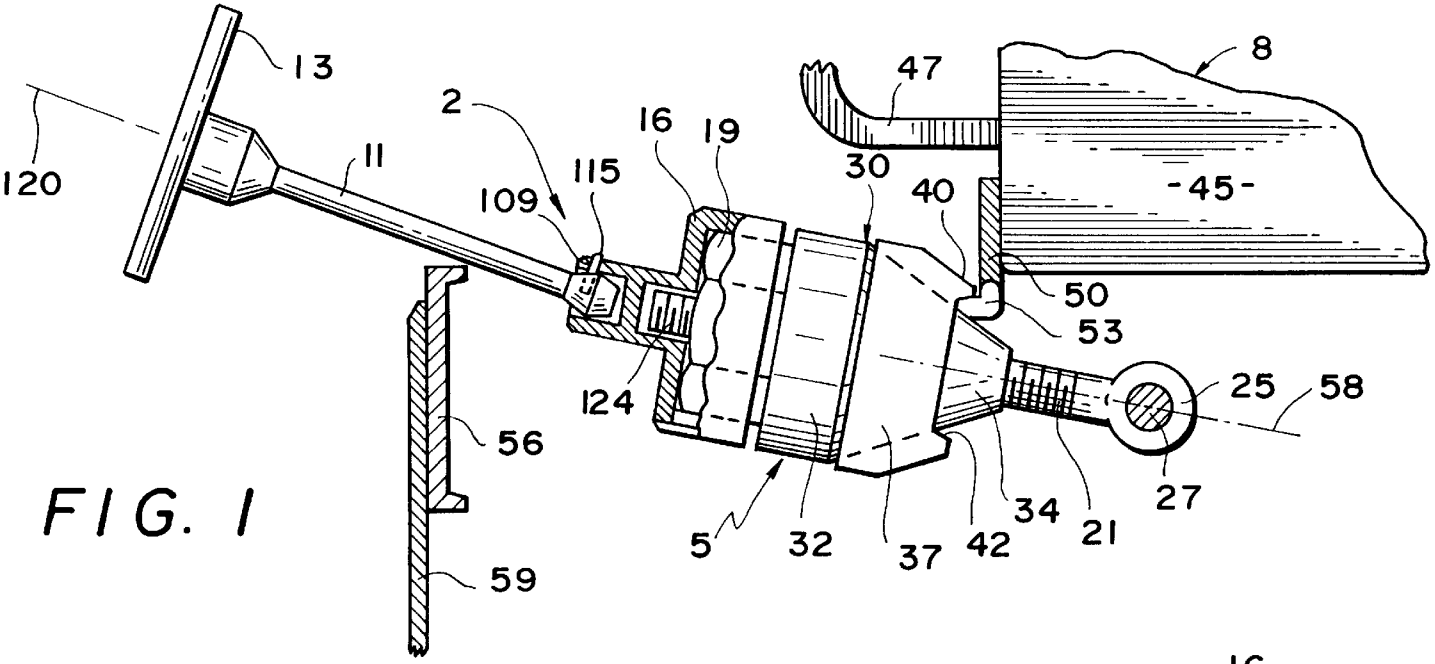
FIG. 1 is partial cross-sectional side view of the socket wrench of the invention attached to the nut of an LRU retaining swingbolt.

With initial reference to FIG. 1, the socket wrench of the invention is generally indicated at 2 and is shown connected to a swingbolt 5 used to secure a line replaceable unit (LRU) 8 in a desired location. Of course, the use of the socket wrench 2 in connection with securing LRU 8 is presented for illustration purposes only and socket wrench 2 may actually be used for various applications.

Socket wrench 2 generally includes a shaft 11, having secured for rotation therewith a handle member 13, and a socket member 16. Socket member 16 is shown extending over a nut 19 provided on a threaded shaft 21 of swingbolt 5. Threaded shaft 21 is provided with an eyelet 25 at one end thereof which enables swingbolt 5 to pivot about an axis defined at 27. Swingbolt 5 also includes a body 30 having a cylindrical portion 32 and a tapered portion 34 that are generally integrally formed. A plastic sleeve 37 is provided about body 30. Sleeve 37 is actually freely rotatable upon body 30 but is prevented from sliding beyond cylindrical portion 32 due to the relative sizing between body 30 and sleeve 37. As illustrated, sleeve 37 is provided with an annular lip 40 that defines, in combination with tapered portion 34, an annular recess 42.

LRU 8 includes a body portion 45 that has secured thereto a handle 47 Handle 47 can be used in inserting or removing the LRU 8 from with a support rack (not shown). LRU 8 also carries a bracket 50 which extends downward from the LRU 8 and terminates in an angled portion 53. This angled portion 53 is adapted to extend within recess 42 when swingbolt 5 is tightened through the use of socket wrench 2 in the manner which will be described more fully hereinafter.

Also illustrated in FIG. 1 is a fixed cross beam or stress member 56 which extends across the rack, i.e. into and out of the page as illustrated in FIG. 1, such that stress member 56 extends above a longitudinal axis 58 defined by threaded shaft 21 such that stress member 56 obstructs direct access to nut 19 by socket wrench 2. Finally, a slidable cover 59 is provided adjacent stress member 56 and is movable between a first position which is shown in FIG. 1 wherein LRU 8 can be accessed and a second position wherein cover 59 is positioned in front of LRU 8.

Again, it should be noted that this particular LRU securing arrangement is presented to illustrate a particular environment in which the use of socket wrench 2 is particularly advantageous. The particular mounting of LRU 8 is only intended to be exemplary and other similar arrangements are known in the art. In general, LRU's are retained in such racks by two or more laterally spaced swingbolts which have to be tightened to commensurate degrees in order to prevent tacking or angling of the LRU which could interfere with electrical connections made when an LRU is placed in a given rack.

Figure 4:
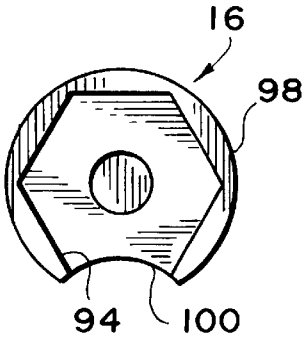
FIG. 4 is an end view taken along line IV—IV of FIG. 2.
Figure 3:
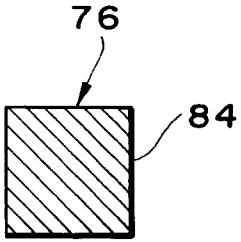
FIG. 3 is a cross-sectional view taken along line III—III of FIG. 2.
Figure 2:
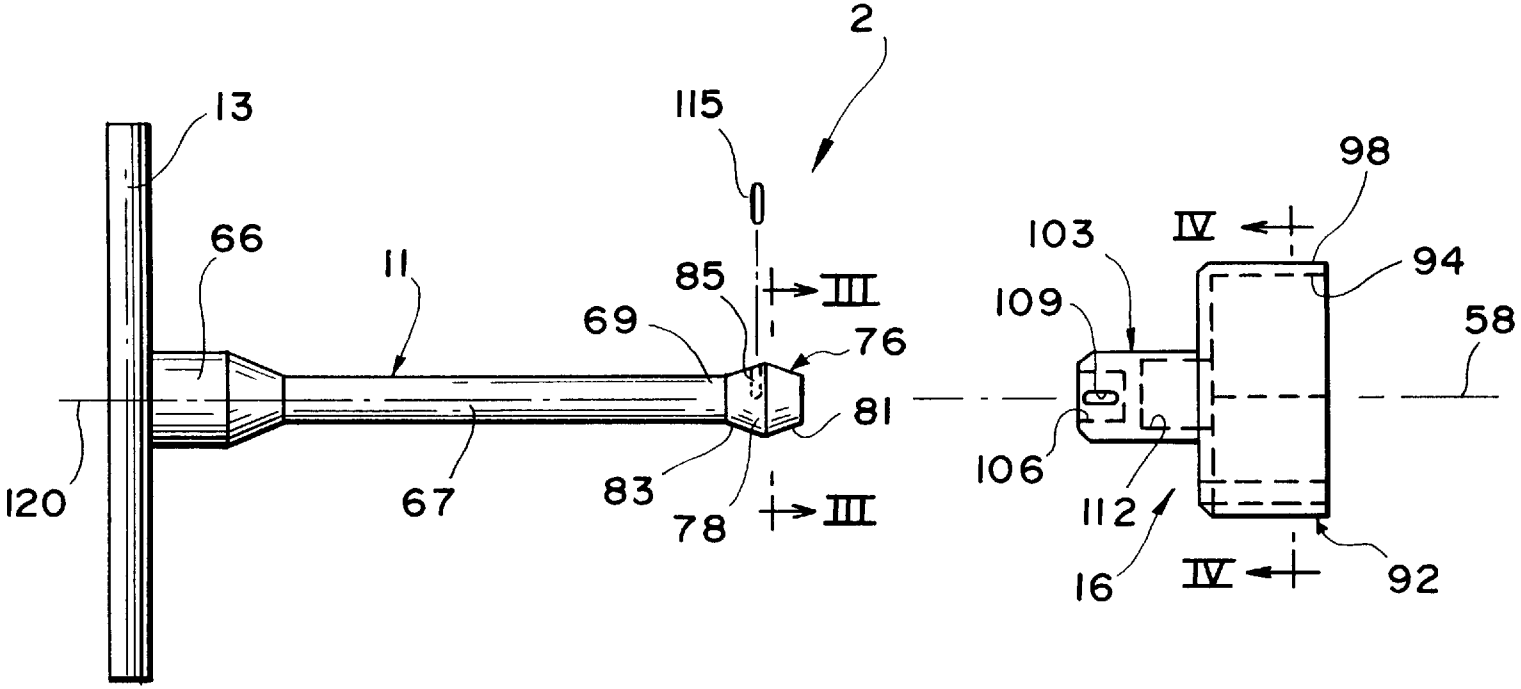
FIG. 2 is an exploded side view of the socket wrench.

Reference will now be made to FIGS. 2–4 in describing the specific construction of socket wrench 2. As shown in FIG. 2, shaft 11 includes a first end portion 66, a central portion 67 and a second end portion 69. First end portion 66 tapers towards central portion 67 and has handle member 13 secured thereto remote from central portion 67. In the preferred embodiment, handle member 13 constitutes a rod that is welded to first end portion 66.

Second end portion 69 includes a terminal end 76 having an intermediate section 78. Terminal end 76 tapers from intermediate section 78 both away from handle member 13 at 81 and towards handle member 13 at 83. As best shown in FIG. 3, the entire terminal end portion 76 has a polygonal cross-section which is preferable square so as to define a plurality of flats 84. Terminal end portion 76 also has a hole 85 extending partially therethrough at intermediate section 78.

Socket member 16 comprises a first diametric portion 92 that includes a socket 94 defined within an annular sidewall 98. As shown in FIG. 4, first diametric portion 92 is generally cylindrical and socket 94 is preferably hexagonal in shape which is sized commensurate to nut 19. Annular sidewall 98 is formed with an arcuately notched-out portion 100. In the preferred embodiment as illustrated in FIG. 4, arcuately notched-out portion 100 extends about one-sixth of annular sidewall 98. As will be explained more fully below, arcuately notched-out portion 100 is provided to enable socket member 16 to be readily placed upon and removed from nut 19 even when additional connectors or the like are obstructing the path of socket wrench 2.

Socket member 16 also includes a second diametric portion 103 that defines a neck of socket member 16. Second diametric portion 103 is provided with a first bore 106 that, although not specifically shown, is also polygonal in cross-section so as to also define flats commensurate with terminal end portion 76. Second diametric portion 103 is also provided with a single aperture 109 in the form of a single slot which extends into first bore 106. In addition, second diametric portion 103 includes a second bore 112 which is spaced along longitudinal axis 58 from first bore 106 and which opens into socket 94.

Finally, socket wrench 2 includes a retaining member 115 for use in securing together shaft 11 and socket member 16. More specifically, terminal end portion 76 is received within first bore 106 beyond intermediate section 78. Retaining member 115 extends through slot 109 and is fixedly secured to terminal end portion 76 within hole 85. In the preferred embodiment, retaining member 115 constitutes a pin which is press-fit within hole 85, however, other retaining arrangements could be readily utilized. For example, hole 85 could be tapped and a threaded member could be secured therein.

In any case, this connection arrangement permits shaft 11 to be angularly adjusted relative to socket member 16 in two planes while also assuring that terminal end portion 76 will remain in direct driving engagement with first bore 106 with flats 84 at 81 and 83 engaging the flats of first bore 106. When used to tighten swingbolt 5, this relative angular adjusting enables a longitudinal axis 120 defined by shaft 11 to be positioned at an obtuse angle to the longitudinal axis 58 defined by threaded shaft 21 which, in turn, enables socket member 16 to be rotated through handle member 13 without shaft 11 abrading stress member 56 as shown in FIG. 1. When tightening of swingbolt 5 occurs, an end portion 124 thereof will be permitted to extend into second bore 112 of socket member 16 as required.

Since terminal end portion 76 is secured to socket member 16, these two members cannot become disengaged. This is important as it assures that socket member 16 will be removed from swingbolt 5 commensurate with the remainder of socket wrench 2 instead of possibly remaining undesirably connected to nut 19. In some aerospace applications, other connectors from adjacent structure to swingbolt 5 may also be present which interferes with socket wrench 2 being readily attached to or removal from swingbolt 5. For example, a bolt or the like could be positioned out of the page at or adjacent nut 19 in the FIG. 1 arrangement. It is for this reason that arcuately notched-out portion 100 is provided which enables socket member 16 to be rotated as necessary to bypass such an interfering connector.

Finally, it should be noted that interconnecting shaft 11 and socket member 16 prevents socket member 16 from being used with a conventional ratchet. This is important since, at least in the specific environment of securing LRU's in airplanes, the multiple swingbolts used to secure a given LRU must be evenly tightened to prevent cocking of the unit which could interfere with the electrical connections made when the LRU is slid into its rack. It has been found that, with utilizing a conventional ratchet, the swingbolts are often damaged and the LRU's not properly secured in place. This occurs mainly due to one of the two spaced swingbolts used to secure a given LRU being unduly tightened prior to tightening of the other swingbolt. This can readily occur with the use of a ratchet which can be easily spun during a tightening sequence but is not performed during use of the socket wrench of the present invention which functions to tighten connectors in increments generally corresponding to one-quarter turns of handle member 13.

Although described with respect to a preferred embodiment of the invention, it should be readily understood that various changes and/or modifications may be made without departing from the spirit of the invention. In general, the invention is only intended to be limited by the scope of the following claims.

We claim:

1. A socket wrench, comprising:

an elongate shaft defining a first longitudinal axis and having first and second longitudinally spaced end portions;

a handle member at said first end portion which is adapted to be manually grasped for rotating said shaft;

a terminal end portion that is polygonal in cross-section formed at said second end portion, said terminal end portion of said shaft including an intermediate section from which said terminal end portion tapers in said first longitudinal direction both towards and away from said handle member;

a socket member having a first diametric portion defining an internal, polygon-shaped socket and a second diametric portion that is aligned along a second longitudinal axis with and extends longitudinally from said first diametric portion;

a first, polygon-shaped bore provided in said second diametric portion which receives said terminal end portion of said shaft;

a retaining member adapted to positively retain said terminal end portion of said shaft in said first bore;

a hole extending partially through said terminal end portion of said shaft; and a single aperture formed in said second diametric portion of said socket member, said aperture extending into said first bore and being aligned with said hole, said aperture being formed by a single slot extending along said second longitudinal axis, said retaining member comprising a pin that extends through said aperture and is fixedly secured to said terminal end portion in said hole;

wherein said terminal end portion of said shaft directly drivingly engages said socket member while being angularly adjustable relative to said socket member such that said first longitudinal axis is arrangable at an obtuse angle to said second longitudinal axis.

* * * * *